United States Patent [19]

Oliver

[11] Patent Number: 4,806,305

[45] Date of Patent: Feb. 21, 1989

[54] DUCTILE NICKEL-SILICON ALLOY

[75] Inventor: Warren C. Oliver, Knoxville, Tenn.

[73] Assignee: Haynes International, Inc., Kokomo, Ind.

[21] Appl. No.: 44,925

[22] Filed: May 1, 1987

[51] Int. Cl.[4] ..... C22C 19/00

[52] U.S. Cl. ..... 420/457; 420/458; 420/459; 420/582; 420/587; 420/902

[58] Field of Search ..... 420/441, 442, 451–460, 420/902, 582, 587; 148/426–429

[56] References Cited

FOREIGN PATENT DOCUMENTS 580686 9/1946 United Kingdom .

*Primary Examiner*—R. Dean

*Attorney, Agent, or Firm*—Joseph J. Phillips

[57] ABSTRACT

Disclosed is a series of silicon rich nickel-base alloys that have a high degree of ductility and hot working properties. The alloys have the corrosion resistant characteristics comparable to cast HASTELLOY® alloy D (Ni - 9 Si - 3 Cu). The alloys have good tensile strength at temperatures up to 600° C. comparing favorably with Alloy IN 718. In addition, the alloys may be produced by super plastic forming (isothermal forging). The nickel-base alloy typically contains 7 to 14% silicon, 0.5 to 6% vanadium, plus a number of optional modifying elements.

8 Claims, No Drawings

DUCTILE NICKEL-SILICON ALLOY

This invention relates to nickel-silicon-copper-base alloys, and, more specifically, to nickel-silicon alloys containing other elements to improve workability and ductility of the alloys.

BACKGROUND AND PRIOR ART

Nickel-silicon-copper alloys have been used in the art for over fifty years to produce cast articles especially suited for use in wet corrosion conditions.

U.S. Pat. Nos. 1,258,227, 1,753,904, 1,769,229 and 3,311,470; also British Pat. Nos. 1,114,398 and 1,161,914 are prior art patents that relate to alloys of this general composition. German Auslegeschift No. 1,243,397 also relates to a somewhat similar alloy. Table 1 presents the overall scope of these patents.

The earliest patent in this art appears to be U.S. Pat. No. 1,076,438 which discloses a nickel-silicon binary with optional contents of manganese or aluminum to remove "shortness" in the alloy. The silicon content is preferred at 3% to 5% because alloys with silicon contents about 7% or over cannot be produced in wrought form. The alloy is defined solely for use as a thermoelectric element.

U.S. Pat. Nos. 1,258,227 and 1,278,304 disclose articles for use as cutting tools containing 86 Ni-6 Al-6 Si-1.5 Zr and 81 Ni-8.4 Al-3.8 Si-6.8 Zr respectively.

TABLE 1

| | COMPOSITION OF PRIOR ART ALLOYS, IN WEIGHT PERCENT, WT % | | | | | |
|---|---|---|---|---|---|---|
| | U.S. PAT. NOS. | | | BRITISH PATENTS | | GERMANY |
| | 1,076,438 | 1,769,229 | 3,311,470 | 1,114,398 | 1,161,914 | 1,243,397 |
| SILICON | 3–7 | up to 10 | 7–16 | about 8.3 | 5–8.5 | 7–16 |
| COPPER | — | AVOID | 0–5 | — | — | 1–4 + MO |
| TITANIUM | — | PRESENT* | 1–5 | about 2.9 | 1–5* | 1–5 |
| ALUMINUM | PRESENT | PRESENT* | — | — | — | — |
| TUNGSTEN | — | PRESENT* | 0–5 | — | | — |
| MANGANESE | PRESENT | PRESENT* | 0–1 | — | | |
| MOLYBDENUM | — | — | 0–5 | — | 3–10* | 1–4 + CU |
| CHROMIUM | — | PRESENT* | — | — | 6–10* | — |
| IRON | — | AVOID | 0–3 | — | 20–30* | — |
| COBALT | — | PRESENT* | 0–10 | — | 25–30* | — |
| VANADIUM | — | PRESENT* | — | — | — | — |
| ZIRCONIUM | — | PRESENT | — | — | — | — |
| NICKEL | BALANCE | BALANCE | BALANCE | BALANCE | BALANCE | BALANCE |

*AT LEAST ONE MUST BE PRESENT

In the present art, only one major alloy is produced under the registered trademark HASTELLOY ® alloy D. The alloy normally contains about 9% silicon, 3.0% copper and the balance nickel. It is available generally only in the form of castings and proposed recently as coatings and articles made from the alloy powder as disclosed in U.S. Pat. No. 4,561,892. The alloy is especially useful in chemical processing plumbing and the like because of its resistance to sulfuric acid in high concentrations.

In the present art, alloy D is produced in cast form with a two-phase structure containing an FCC solid solution phase known as "alpha" and an intermetallic ordered phase, $Ni_3Si$ also known at "beta". Present also may be the $Ni_5Si_2$ phase which contributes to the unsatisfactory mechanical properties of the alloy, ie low ductility and poor to nil working characteristics. The alloy is notoriously weak at room temperatures and up to 600° C.

Because of these limitations, the nickel-silicon alloys could not be used more extensively in the art.

OBJECTS OF THE INVENTION

It is the primary object of this invention to provide a ductile nickel-silicon alloy that may be produced as a wrought product.

It is another object of this invention to provide a ductile nickel-silicon alloy that has super plasticity.

TABLE 2

| | COMPOSITION OF THE ALLOY OF THIS INVENTION, IN WT % (NICKEL PLUS IMPURITIES - BALANCE) | | | | | | | |
|---|---|---|---|---|---|---|---|---|
| | Broad Range | Preferred Range | Nominal Alloys | | | | | |
| | | | A | B | C | E | F | G |
| Silicon | 7–14 | 8–12.5 | about 10 | about 10 | about 10 | 9.8 | 9.5 | 9.5 |
| Vanadium | 0.5–6 | 1–3.5 | about 2 | about 3 | — | — | 3 | 3 |
| Niobium | up to 6 | 1.5–5 | — | — | about 3.5 to 4.5 | 2 | — | — |
| Niobium plus Tantalum | up to 10 | 1.5–10 | about 3.5 | — | — | — | — | — |
| Cr + Mn + Fe | up to 30 | — | — | — | — | 3.2 Cr | — | — |
| Mo + W | up to 15 | — | — | — | — | — | — | — |
| Nb + Ta + Cr + Mn + Fe + Mo + W | 1–30 | 1–30 | 3.5–30 | about 5 Fe | about 3 Cr | — | 2 Fe | 5 Fe |
| B | up to 0.2 | — | up to .1 | — | — | — | — | — |
| Cu | 0.5–5 | .5–3.5 | — | — | — | 2.5 | 2.5 | 2.5 |
| Titanium | 1 Max. | .5 Max | — | — | — | — | — | — |

It is still another object of the invention to provide an alloy that has high mechanical strength up to 600° C. for use as turbine discs and shafts and pump impellers.

SUMMARY OF THE INVENTION

The objects listed above are met by the provision of the alloy as defined in Table 2. The alloy of this invention may contain certain elements that may be added, for example, lanthanum, rare earth metals, zirconium, cobalt, hafnium, aluminum, calcium and the like. These elements may be used during production for deoxidation, improved castability and workability as known in the art. Other elements may be present adventitiously from the use of scrap as raw material in melting, for example, sulfur, phosphorus, lead, and the like.

TEST RESULTS AND DISCUSSION

Corrosion resistant alloys containing a high silicon content historically have been essentially cast alloys because of the hard brittle nature of the alloys. There is a commercial need for a ductile alloy of this class in the form of wrought products. Hot fabricability is the highly desired characteristic. A series of tests were conducted to determine favorable additions to improve the hot workability of nickel alloys with silicon at various contents. The alloys were arc melted at least three times then drop cast into a water-cooled copper mold to a 1" to ½ to 5" ingot. The ingots were homogenized at least two hours at 1000° C. prior to the hot working step. The ingots were hot forged and hot rolled at 1000° C., 1050° C. and 1100° C.

The alloy has also been prepared experimentally by electroslag remelting (ESH) process without difficulty. Other methods of production may be used within the skill of the art.

Table 3 presents at a glance the results of the testing program. All numbers signify percent by weight of element as noted. The letters are generally defined in the KEY. "F-Forge and R-Roll" indicate the hot working step. "L-1000° C., M-1050° C. and H-1100° C. indicate the hot working temperature. "E-Excellent, G-Good and P-Poor" indicate the evaluation of the product after hot working. "T-Terr" (terrible) suggests total failure (rupture, etc.) of the sample. "W-Melt" indicates the sample melted during the hot working step.

Note the binary alloys hot worked well with contents of silicon 8.2 to 13.4%. However, the 16% binary silicon alloy had poor hot working properties.

The data show alloys with titanium additions of more than about 1% have poor hot working properties. Thus, titanium is limited to less than 1% and preferably not over 0.5% as an impurity. Vanadium appears to be the most effective addition whether alone or with other elements, to promote hot workability Every alloy containing vanadium (except 2 V+4 Mo+0.02 B) had good-to-excellent hot working properties.

An overall consideration of factors suggest a number of possible generalizations concerning the addition elements to nickel-silicon alloys.

TABLE 3

Hot fabricability tests on Ni—Si—base alloys

Hot Working Ni—Si Alloys

| Si> | 8.2 | 8.5 | 8.9 | 9.0 | 9.3 | 9.7 | 10.1 | 12.0 | 13.8 |
|---|---|---|---|---|---|---|---|---|---|
| 2.6 Ti, .02 B | FHE<br>FLP-G | | | | | | FHE | FHE | FHE |
| 2.6 Ti, Hi | FHT | | | | | | | | |
| 3.1 V | | FLP-G<br>FHE | | | | | | | |
| 3.1 V | | | FLP-G<br>FRHE | | | | | | |
| 3.1 V, 1 Mo | | | | FLP-G<br>FRHE | | | | | |
| 3.1 V, 2 Mo | | | | FLP-G<br>FRHE | | | | | |
| 3.1 Mo, 4 Mo | | | | FLG<br>FHE | | | | | |
| 3.1 V | | | | | FLP-G<br>RLG | | | | |
| 2.0 V | | | | | FLP<br>FHE | | | | |
| 3.1 V, 10 Fe | | | | | FLE<br>FRHE | | | | |
| 3.1 V, 15 Fe | | | | | FLE<br>FRHE | | | | |
| 2.9 Ti | | | | | | | RHT<br>RLT | | |
| 3.1 V | | | | | | | FHE | | |
| 3.16 Cr | | | | | | | RHE<br>FHE | | |
| 5.67 Mo | | | | | | | RHE<br>FHE | | |
| 3.2 Mn | | | | | | | FRHE<br>FLT | | |
| 10.3 W | | | | | | | FHE | | |
| 10.1 Hf | | | | | | | FHW | | |
| 5.4 Zr | | | | | | | FHW | | |
| 2.5 V, 3 Fe | | | | | | | RHE | | |
| 3.1 V, 4 Fe | | | | | | | RHE | | |
| 3.1 V, 15 Fe | | | | | | | FRHE<br>FLE | | |
| 4.5 Nb | | | | | | FLT | | | |
| 5.5 Nb | | | | | | FLT | | | |

| Si> | 9.7 | 10.1 | 12.0 | 12.2 | 12.8 | 13.4 | 16.0 |
|---|---|---|---|---|---|---|---|
| BINARY | | RHE<br>FHE | RHE<br>FHE | RHE<br>FHE | RHE<br>FHE | RHE<br>FHE | FMP |
| 2.5 V, 3 Mo | | RHE<br>FHE | | | | | |
| 2 V, 4 Mo | | RHE | | | | | |

TABLE 3-continued

| Hot fabricability tests on Ni—Si—base alloys | | | | |
|---|---|---|---|---|
| Hot Working Ni—Si Alloys | | | | |
| | FHE | | | |
| 2 Y, 4 Mo, 0.02 B | FHP | | | |
| 3.1 V, 5 Fe | RHE | | | |
| | FHE | | | |
| 2 V, 3.2 Cr | RHE | | | |
| | FHE | | | |
| 2 Y, 3.2 Cr, 0.02 B | FHP | | | |
| 1.0 Nb | FMT | | | |
| 4.5 Nb | FMT | | | |
| 4.5 Nb, 4 Mo | FMLT | | | |
| 4.5 Nb, 5 Fe | FMT | | | |
| 4.5 Nb, 3.2 Cr | FHWMGLE | | | |
| | RLE | | | |
| 3.5 Nb, 3.2 Cr | FME | | | |
| | RME | | | |
| 1 Ti | FMT | | | |
| 2.9 Ti, 4 Mo | FHLT | | | |
| 2.9 Ti, 5 Fe | FMT | | | |
| 2.9 Ti, 3.2 Cr | FMT | | | |
| 3.3 Fe | FHE | | | |
| | RHE | | | |
| 2.0 Cr | FHE | | | |
| | RHE | | | |
| 4.0 Cr | FHE | | | |
| | RHE | | | |
| 0.005 B | | FME | FMG | FMP |
| 0.01 B | | FMG | | |
| | | RMP | | |
| 0.015 B | | FMG | | |
| | | RMP | | |
| 0.02 B | FHP | FL-H | | |
| | | P-G-P | | |

KEY
F — FORGE
R — ROLL
L — 1000 C
M — 1050 C
H — 1100 C
E — EXCEL
G — GOOD
P — POOR
T — TERR
W — MELT

1. It appears that silicon provides corrosion resistance.

2. Room temperature ductility is generally enhanced by the vanadium, columbium and tantalum additions.

3. Hot fabricability is improved with additions of chromium, manganese, iron, molybdenum and tungsten. Low temperature strength is improved with molybdenum and tungsten.

4. Boron may also provide a degree at improved room temperature ductility, however, it must be added sparingly to avoid hot working problems.

These generalizations are helpful in the determination of which alloy to use in specific conditions. Therefore the ranges in Table 2 cover the overall broad concept of the invention; however, all elements are not always required.

Table 2, 3, 4, and 5 list alloys of this invention prepared as described above. These alloys had good to excellent hot working properties. In addition they were tested for tensile strength and super plasticity with results in Tables 4 and 5. These data show the alloys as described in Table 2 have an unexpected combination of properties for high-silicon nickel base alloys. All had good to excellent hot working and cold rolling characteristics. Surprisingly some had a high degree of super plasticity as shown in Table 4.

Alloy C, disclosed in Table 2, had no vanadium addition but contained 3.5 and 4.5% niobium and about 3% chromium.

TABLE 4

| Nickel—Silicon Base Alloys that Demonstrate Super Plasticity | |
|---|---|
| Composition | Highest Strain to Failure Observed, % |
| Ni—10.1Si—3.16Cr | 177 |
| Ni—10.1Si—5.67Mo | 310 |
| Ni—10.1Si—3.1V—2Mo | 203 |
| Ni—9.0Si—3.1V—1Mo | 440 |
| Ni—9.3Si—3.1V—15Fe | 204 |
| Ni—9.3Si—2V | 222 |
| Ni—9.3Si—3.1V—10Fe | 243 |
| Ni—10.1Si—3.1V—4Mo | 532 |
| Ni—10.1Si—2.5V—3Mo | 408 |
| Ni—10.1Si—3.1V—5Fe | 573 |
| Ni—10.1Si—2V—4Mo | 288 |
| Ni—10.1Si—4Cr | 156 |

Alloy E also had no vanadium addition but contained about 2% niobium and about 2.5% copper. The good engineering properties of these alloys suggest that vanadium, although highly desirable, is not essential.

SUPER PLASTICITY

Many of the alloys that were found to be hot fabricable are super plastically formable in the wrought form. Table 4 shows the alloys that demonstrated super-plasticity tensile elongation (>100% strain to failure) at a standard tensile testing strain rate of 20% per minute.

These results suggest that the two phase high temperature microstructure of these alloys results in a very fine microstructure after hot working.

Although the exact mechanism is not completely understood, it is believed that the effect of the Cr, Mn, Mo, Fe, and W seems to be a reduction of cavitation. These characteristics are essential in the production of commercial products by super-plastic forming, also known as isothermal forging.

The outstanding improvements in mechanical properties in addition to super plasticity also include high strengths up to 600° C. as objects of this invention.

By way of example, one nickel base alloy containing 10.1% silicon, 2% vanadium, and 4% molybdenum was tested at various temperatures up to 1080° C. Test data, as presented in Table 5, show strengths up to 600° C. to exceed or are comparable to

TABLE 5

Tensile Properties of an Alloy of This Invention (Ni—10.1Si—2V—4Mo)

| Heat Treatment | Test Temperature (°C.) | Yield Strength (Ksi) | Tensile Strength (Ksi) | Elongation % Measured |
|---|---|---|---|---|
| 16 h @ 900° C. | R.T. | 123.8 | 211.6 | 12.0 |
| 16 h @ 900° C. | R.T. | 127.4 | 204.7 | 10.5 |
| 16 h @ 900° C. | 500 | 135.8 | 187.0 | 13.1 |
| 16 h @ 900° C. | 600 | 139.8 | 155.0 | 5.6 |
| 16 h @ 900° C. | 700 | 99.1 | 119.4 | 5.0 |
| 16 h @ 900° C. | 800 | 79.8 | 93.3 | 1.4 |
| 16 h @ 900° C. | 1000 | 4.8 | 11.6 | 128.3 |
| 16 h @ 900° C. | 1080 | 2.2 | 2.6 | 288.2 |
| 16 h @ 900° C. | 1080 | 2.3 | 2.8 | 248.9 |

requirements for turbine disks and shafts. For example, the alloy of this invention compares favorably with Alloy IN 718 now used in the art.

WET CORROSION RESISTANCE

Because these alloys are extensively used under wet corrosion conditions, tests were run to learn the effects of the addition of modifying elements to the basic nickel-silicon alloy. Table 6 presents data obtained from tests in boiling sulfuric acids at 60 and 77% concentrations for 96 hours. These tests indicate vanadium and chromium increase corrosion rates while niobium and titanium reduce corrosion rates.

Table 7 presents the effects of metal working on the corrosion rates of two selected alloys. Two alloys were each tested as cast and after hot and cold working. As shown in Table 7, thermomechanical treatment had a slight effect on corrosion rates. In the 60% acid, the corrosion rates are high so that the differences in corrosion rates between the two treatments may not be of major significance. In the 77% acid, the as-cast plus annealed alloys had significantly lower corrosion rates than the cold-worked plus annealed alloys.

Additional corrosion tests were completed for selected alloys as shown in Table 8. As can be seen, the addition of Mo, Fe or Cr to the Ni-10Si binary alloy was not beneficial to corrosion resistance. Addition of Mo or Cr to Ni-10Si-V alloys were also not beneficial.

TABLE 6

Results of Corrosion Tests on a Variety of Ni—Si Alloys in Boiling Acids

| Alloy | Corrosion Rate (Mils per year) 60% $H_2SO_4$ | 77% $H_2SO_4$ |
|---|---|---|
| Ni—10Si | 3640 | 35 |
| Ni—10Si—2.9Ti | 358 | 1 |
| Ni—10Si—5.5Nb | 160 | 3 |
| Ni—10Si—3.2Cr | 2300 | 70 |
| Ni—9.3Si—20V | 3800 | 47 |
| Ni—9.3Si—3V | 3100 | 25 |
| Ni—9Si—3V—1Mo | 3200 | 33 |
| Ni—9Si—3V—2Mo | 2100 | 25 |

TA8LE 7

Effect of Thermomechanical Treatment on Corrosion Rates

| Alloy | Treatment* | Corrosion Rate (mpy) 60% $H_2SO_4$ | 77% $H_2SO_4$ |
|---|---|---|---|
| Ni—9Si—3V—1Mo | A - Cast | 3200 | 33 |
| Ni—9Si—3V—1Mo | B - Wrought | 2100 | 50 |
| Ni—9Si—3V—2Mo | A - Cast | 2400 | 25 |
| Ni—9Si—3V—2Mo | B - Wrought | 1100 | 62 |

Treatments*
A - Cast + 4 hours at 1000° C.
B - Cast + 4 hours at 1000° C. + hot-rolled + 2 hours at 1000° C. + cold rolled + 2 hours at 1000° C.

TABLE 8

Results of Corrosion Tests on Experimental Samples

| Alloy | TMT | Corrosion Rate (mpy) 60% $H_2SO_4$ | 77% $H_2SO_4$ |
|---|---|---|---|
| 8.15Si | HR 1090° C./4 HRS, 900° C./16 HRS, 1000° C. | 1157 | 189 |
| 10.1Si | HR 1100° C./16 HRS, 1000° C. | 3640 | 33 |
| 10Si—2Cr | HR 1080° C./16 HRS, 925° C. | 3200 | 53 |
| 10Si—4Cr | HR 1080° C./16 HRS, 925° C. | 1365 | 37 |
| 10Si—3Fe | HR 1090° C./2 HRS, 1100° C./16 HRS, 1000° C. | 3900 | 39 |
| 10Si—4.5Cb—3Cr | HR 1100° C. | 590 | 29 |
| 10Si—2V—3Cr | HR 1080° C./16 HRS, 925° C. | 2600 | 17 |
| 10.1Si—3V—4Mo | HR 1100° C./4 HRS, 900° C./16 HRS, 900° C. | 2300 | 55 |
| 10.1Si—2V—4Mo | Same as above | 1430 | 21 |
| 10.1Si—2.5V—3Mo | HR 1100° C./2 HRS, 1080° C./4 HRS, 900° C./16 HRS, 900° C. | 1362 | 16 |
| 10.1Si—3V—5Fe | HR 1100° C./2 HRS, 1080° C./4 HRS, 900° C./16 HRS, 900° C. | 1750 | 0.7 |

However, addition of 5 Fe to Ni-10Si-3V was found to be beneficial in 77% $H_2SO_4$ and to a limited extent in 60% $H_2SO_4$. In the latter solution, the corrosion rates were low initially and increased to high values at longer times. Table 9 presents corrosion data relating to the addition of copper in selected alloys. Copper additions generally were found to be beneficial to alloys of this class.

In alloys of this class copper may be present up to about 0.5% as an adventitious element introduced from scrap as a raw material. About 0.5% may be considered a preferred minimum content.

It will be apparent to those skilled in the art that the novel principles of the invention disclosed herein, in connection with specific examples thereof, will support various other modifications and applications of the same. It is accordingly desired that, in construing the breadth of the appended claims, they shall not be limited to the specific examples of the invention described herein.

TABLE 9

Corrosion Rates of Selected Alloys Containing Copper

| Alloy | Corrosion Rate (mpy) 60% $H_2SO_4$ Boiling | Corrosion Rate (mpy) 77% $H_2SO_4$ Boiling |
|---|---|---|
| 9.5Si—2Cb—3.2Cr—2.5Cu | 890 | 59 |
| 9.5Si—3V—2Fe—2.5Cu | 1250 | 5 |
| 9.5Si—3V—5Fe—2.5Cu | 1800 | 17 |

What is claimed is:

1. A ductile alloy with good hot working properties and capable of becoming superplastic consisting essentially of, in weight percent:

| | |
|---|---|
| Silicon | 7 to 14 |
| Vanadium | 0.5 to 6 |
| Niobium | up to 6 |
| Nb + Ta | up to 10 |
| Cr + Mn + Fe | up to 30 |
| Mo + W | up to 15 |
| Nb + Ta + Cr + Mn + Fe + Mo + W | up to 30 |
| Boron | up to 0.2 |
| Copper | 0.5 to 5 |
| Titanium | 1 maximum |
| Nickel plus impurities | Balance. |

-continued

2. The alloy of claim 1 containing:

| | |
|---|---|
| Silicon | 8 to 12.5 |
| Vanadium | 1 to 3.5 |
| Niobium | 1.5 to 5 |
| Nb + Ta + Cr + Mn + Fe + Mo + W | 1 to 30 |
| Copper | 0.5 to 3.5 |
| Titanium | 0.5 maximum |
| Nickel plus impurities | Balance. |

3. The alloy of claim 1 containing about 10 silicon, about 2 vanadium, about 3.5 niobium plus tantalum, 3.5 to 30 Nb+Ta+Cr+Mn+Fe+Mo+W and up to 0.1 boron.

4. The alloy of claim 1 containing about 10 silicon, about 3 niobium and about 5 iron.

5. The alloy of claim 1 containing about 10 silicon, about 3.5 niobium and about 3 chromium.

6. The alloy of claim 1 containing about 9.8 silicon, about 2 niobium, about 3.2 chromium and about 2.5 copper.

7. The alloy of claim 1 containing about 9.5 silicon, about 3 vanadium, about 2 iron, and about 2.5 copper.

8. The alloy of claim 1 containing about 9.5 silicon, about 3 vanadium, about 5 iron and about 2.5 copper.

* * * * *